US007720404B2

(12) United States Patent
Wen et al.

(10) Patent No.: US 7,720,404 B2
(45) Date of Patent: May 18, 2010

(54) METHODS OF OPERATING A MULTI-COLOR IMAGE FORMING DEVICE IN A MONO-COLOR MODE

(75) Inventors: Jian Wen, Lexington, KY (US); David Anthony Schneider, Lexington, KY (US); Delbert Lester Elliott, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 192 days.

(21) Appl. No.: 11/947,862

(22) Filed: Nov. 30, 2007

(65) Prior Publication Data

US 2009/0142090 A1 Jun. 4, 2009

(51) Int. Cl.
*G03G 15/00* (2006.01)
*G03G 15/01* (2006.01)

(52) U.S. Cl. ..... 399/82; 399/76; 399/299; 399/302

(58) Field of Classification Search ..... 399/82, 399/75, 76, 77, 223, 227, 228, 299, 298, 399/302

See application file for complete search history.

(56) References Cited

U.S. PATENT DOCUMENTS

2005/0025513 A1* 2/2005 Ichikawa et al. ..... 399/82
2006/0239698 A1* 10/2006 Yamada et al. ..... 399/227 X
2007/0025778 A1* 2/2007 Akizuki et al. ..... 399/299

* cited by examiner

*Primary Examiner*—Sophia S Chen

(57) ABSTRACT

The present application is directed to methods of operating a multi-color image forming device in a mono-color mode. The methods may include performing three basic loops during the printing in the mono-color mode. A first loop may include printing mono-color pages up to an initial preset maximum. The preset maximum may prevent a wear mark from forming on the non-operational PC members due to rubbing against the moving ITM. A second loop may occur when the mono-color pages exceeds the initial preset maximum. The second loop may include rotating the non-operational imaging stations to prevent wear. A third loop may occur when the number of mono-color images exceeds an overall maximum number. The third loop may include resetting the non-operational image forming stations to allow for continuing printing in the mono-color mode.

19 Claims, 4 Drawing Sheets

METHODS OF OPERATING A MULTI-COLOR IMAGE FORMING DEVICE IN A MONO-COLOR MODE

BACKGROUND

The present application is directed to methods of forming a toner image and particularly to methods of forming a mono-color toner image within a multi-color image forming device.

Color image forming devices such as but not limited to printers, facsimile machines, copiers, and combination machines form images with two or more different colors of toner. Each color of toner may be stored within an imaging station and transferred to an intermediate member as a toner image during the image formation process. For multi-color images, two or more different colors of toner are transferred to the intermediate member and combined to form the final image. For mono-color images, a single color of toner forms the final image.

Each imaging station includes at least one photoconductive member. During the image formation process, the imaging stations are activated and the photoconductive member is rotated. Further, the toner is moved within the image forming station. The life of the photoconductive member is largely determined by the total number of revolutions. Further, the toner within the imaging stations is churned during the image forming process which also decreases its effective life. Prior art image forming devices have addressed extending the lives of the photoconductive members and toner in a variety of different manners.

Many standard image forming device do not treat a multi-color image differently than a mono-color image. The imaging stations for the non-used toner continue to rotate the photoconductive member and churn the toner even though no toner is transferred from that specific station. Other image forming devices use a mechanism that retracts the intermediate member away from the photoconductive member. This may increase the life of the photoconductive member, but adds complexity and cost to the image forming device.

SUMMARY

The present application is directed to methods of operating a multi-color image forming device in a mono-color mode. One method may include determining whether an initial maximum number of mono-color pages have been printed. When the initial maximum number of mono-color pages has not been printed, the mono-color page may be printed with a first imaging station while the remainder of the imaging stations are in a non-operational mode. When the initial maximum number of mono-color pages has been printed, the non-operational imaging stations may be rotated a limited first amount and the mono-color page may be printed with the first imaging station. When an overall number of mono-color pages have been printed, the non-operational imaging stations may be reset by rotating the non-operational imaging stations a greater amount than the first amount.

DETAILED DESCRIPTION

Figure 1:
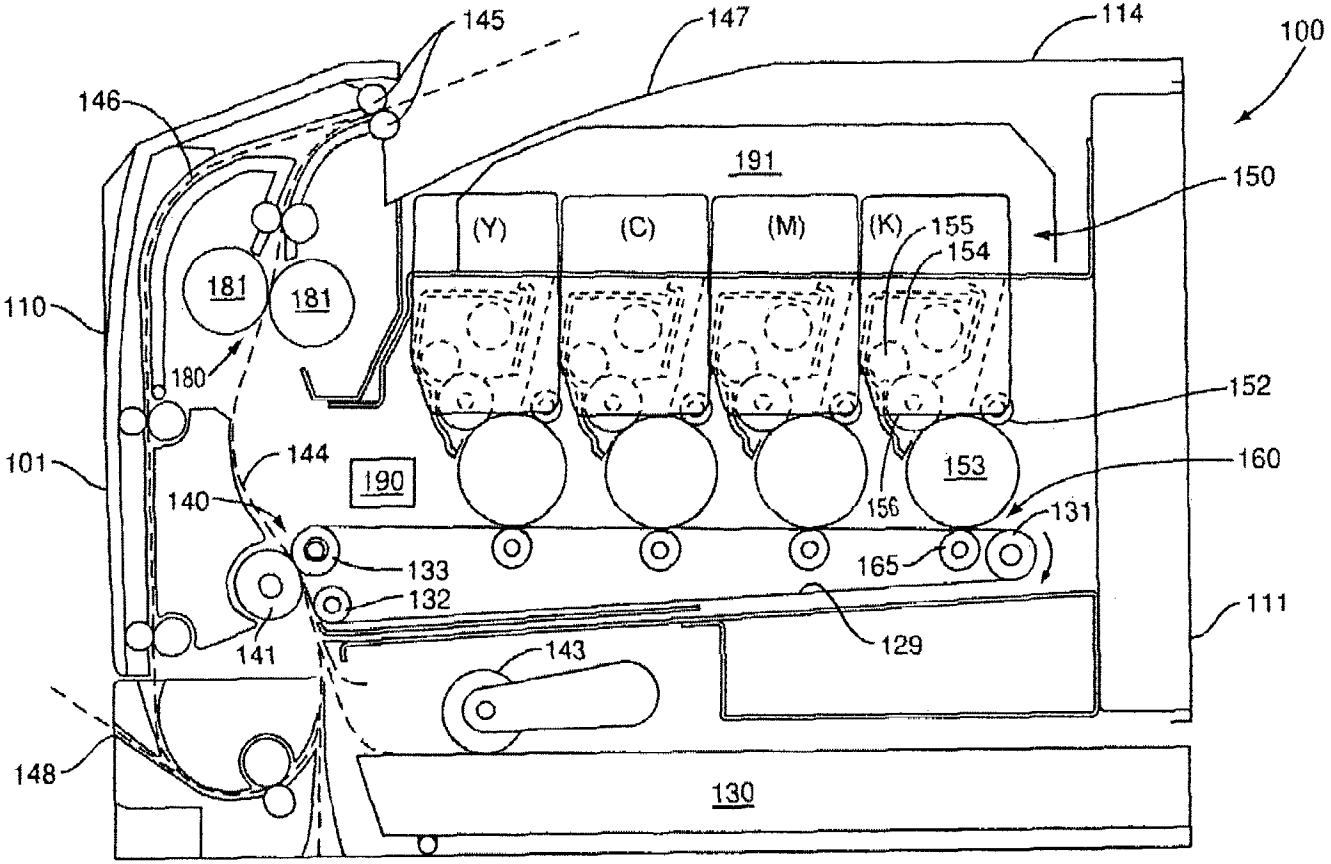
FIG. 1 is a schematic view of an image forming device according to one embodiment.

FIG. 1 illustrates one embodiment of an image forming device 100. The device 100 includes a first toner transfer area 160 with one or more imaging stations 150 that are aligned horizontally extending from the front 110 to the back 111 of the body 101. The imaging stations 150 are aligned along an intermediate transfer member (ITM) 129. Each of the imaging stations 150 holds a different toner color. The imaging stations 150 are aligned in order relative to the direction of the ITM 129 with the yellow (Y) imaging station 150 being first and followed by cyan (C), magenta (M), and black (K).

Each imaging station 150 includes a toner reservoir 154 to contain the toner. One or more agitating members may further be positioned within the reservoir 154 to move the toner. A toner adder roller 155 is positioned in the reservoir 154 to move the toner to a developer roller 156. The imaging stations 150 also include a photoconductive member 153 that receives toner from the developer roller 156. A charging member 152 is positioned to charge the photoconductive (PC) member 153. In one embodiment, each of the imaging stations 150 is substantially the same except for the color of toner. For purposes of clarity in FIG. 1, the elements are labeled on only the black K imaging station 150.

During image formation, the surface of the PC member 153 is charged to a specified voltage such as −800 volts, for example. A laser beam from a printhead 191 is directed to the surface of the PC drum 153 and discharges those areas it contacts to form a latent image. In one embodiment, areas on the PC drum 153 illuminated by the laser beam are discharged to approximately −100 volts. The developer roller 156 then transfers toner to the PC drum 153 to form a toner image. The toner is attracted to the areas of the PC drum 153 surface discharged by the laser beam from the printhead 191.

The ITM 129 is disposed adjacent to each of the imaging stations 150. In this embodiment, the ITM 129 is formed as an endless belt trained about drive roller 131, tension roller 132 and back-up roller 133. During image forming operations, the ITM 129 moves past the imaging stations 150 in a clockwise direction as viewed in FIG. 1. One or more of the PC drums 153 apply toner images in their respective colors to the ITM 129. For mono-color images, a toner image is applied from a single imaging station 150. For multi-color images, toner images are applied from two or more imaging stations 150. In one embodiment, a positive voltage field formed by transfer rollers 165 attracts the toner image from the PC drums 153 to the surface of the moving ITM 129.

The ITM 129 rotates and collects the one or more toner images from the one or more imaging stations 150 and then conveys the toner images to a media sheet at a second transfer area. The second transfer area includes a second transfer nip 140 formed between the back-up roller 133 and a second transfer roller 141.

A media path 144 extends through the device 100 for moving the media sheets through the imaging process. Media sheets are initially stored in an input tray 130 or introduced into the body 101 through a manual feed 148. The media sheet receives the toner image from the ITM 129 as it moves through the second transfer nip 140. The media sheets with toner images are then moved along the media path 144 and into a fuser area 180. Fuser area 180 includes fusing rollers or belts 181 that form a nip to apply heat and pressure to fix the toner image to the media sheet. The fused media sheets then pass through exit rollers 145 that are located downstream from the fuser area 180. Exit rollers 145 may be rotated in either forward or reverse directions. In a forward direction, the exit rollers 145 move the media sheet from the media path 144 to an output area 147 along the top portion 114 of body 101. In a reverse direction, the exit rollers 145 move the media sheet into a duplex path 146 for image formation on a second side of the media sheet.

During formation of a multi-color image, toner images from two or more of the imaging stations 150 are transferred to the ITM 129. In one embodiment, multi-color images require the image forming device 100 to operate in a multi-color mode with each of the imaging stations 150 being operational, even if a particular color is not included in the toner image. The image forming device 100 may also operate in a mono-color mode to form a mono-color image with a single color of toner. One example of a mono-color mode is referred to as black-only that forms images with just black toner. Specific examples of black-only printing include text and black-and-white images.

During the mono-color mode, a toner image is formed at the last imaging station 150 in the process direction and transferred to the ITM 129. The operational imaging station 150 should be after the non-operational imaging stations 150 in the process so the toner image is not disturbed while traveling under a stationary PC member 153. The present application includes methods to deactivate the other non-operational imaging stations 150 to prevent wear to their various elements and their toner.

A controller 190 is included within the image forming device 100 to control the overall printing process including creation and timing of the toner images, and movement of the media sheets. Controller 190 may include a microprocessor with associated memory. In one embodiment, controller 190 includes a microprocessor, random access memory, read only memory, and an input/output interface. Controller 190 receives print requests and forms a queue of each of the pages in the requests. The queue may include the pages from a single print request. or may include pages from two or more different print requests. Controller 190 further includes a raster image processor that turns vector digital information received in the print requests into a high-resolution raster image. The controller 190 is then able to determine whether each of the pages require a multi-color mode due to two or more colors of toner being necessary to form the image, or a mono-color mode when a single color of toner is necessary to form the image.

In one embodiment, the controller 190 may normally operate in the multi-color mode. The multi-color mode includes the operation of each of the imaging stations 150 including rotation of at least the developer roller 156, PC member 153, and charging roller 152, and movement of the toner. A drawback to print a mono-color page while operating in the multi-color mode is wear on the elements of the imaging station 150 and churning of the toner. The present application includes methods of determining when the controller 190 can operate in the mono-color mode such that only one imaging station 150 is operational and the other imaging stations 150 are non-operational. The elements of the non-operational imaging stations 150 are stationary to prevent the wear and churn of the toner.

The methods of the present application include steps to maintain the image forming device 100 operating in the mono-color mode. The first loop includes continuous mono-color printing to an initial preset maximum number of mono-color pages. The second loop occurs when the number of printed mono-color pages exceeds the initial preset maximum. The second loop includes rotating the non-operational imaging stations 150. A third loop occurs when the number of rotations in loop 2 exceeds a maximum number. The third loop includes resetting the non-operational image forming stations 150 to allow for continuing operation in the mono-color mode.

In the method described below and illustrated in FIGS. 2 and 3, the mono-color mode is a black-only mode. Only the K imaging station 150 is operational with the Y, C, and M imaging stations 150 being non-operational. Further, this example includes a single operational imaging station 150 and three non-operational imaging stations 150. In other embodiments, two or more adjacent imaging stations 150 that are last in the process may be operational with one or more non-operational imaging stations 150.

Figure 2:
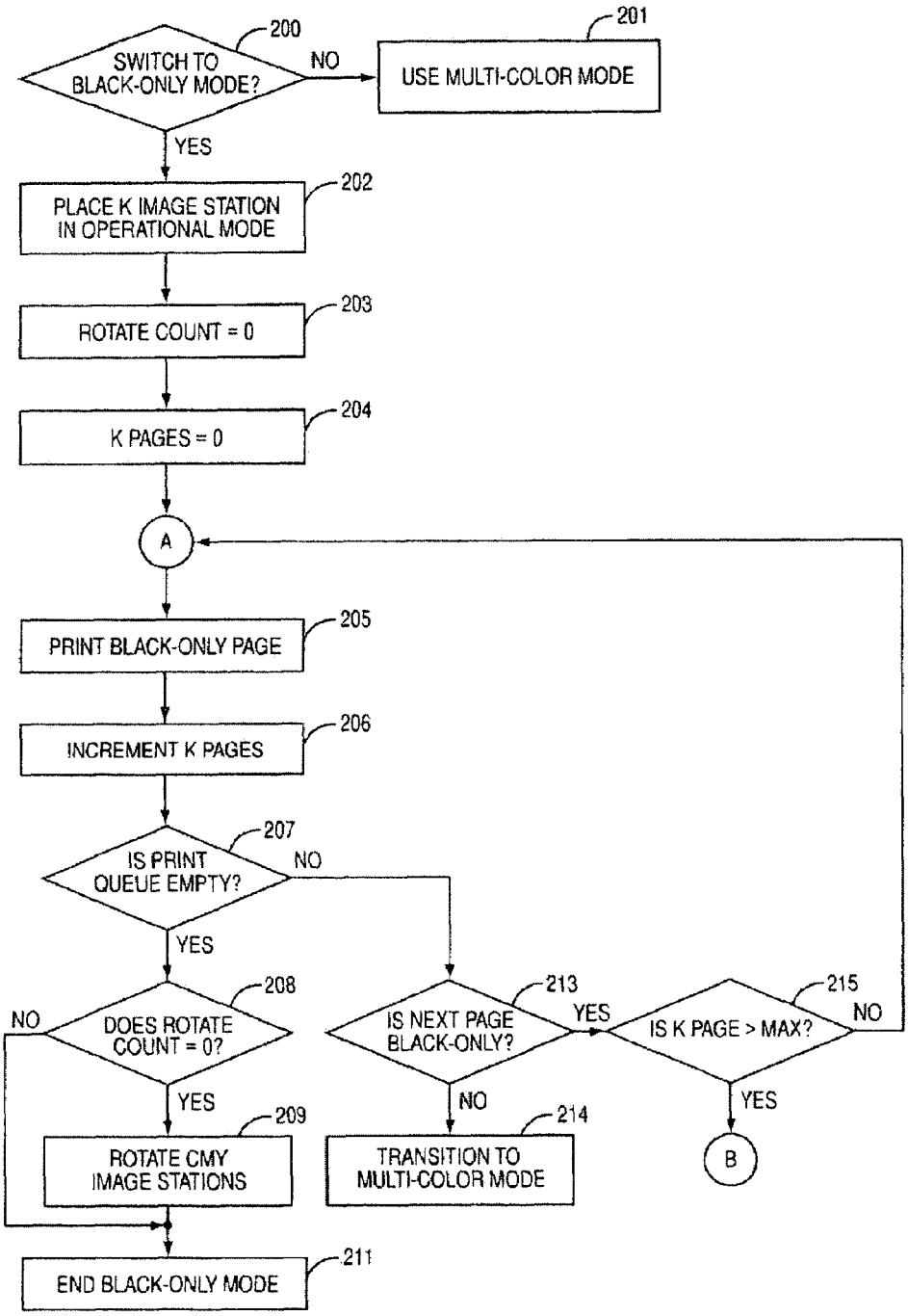
FIG. 2 is a process diagram of a partial method of forming a toner image according to one embodiment.

As illustrated in FIG. 2, an initial step is determining if the controller 190 should switch from the multi-color mode to the black-only mode (step 200). Although the black-only mode includes advantages of preventing wear and toner churn to the non-operational imaging stations 150, too much switching between the modes causes extra wear to the non-operational imaging stations 150 because of the frequent starting and stopping. This extra wear is more detrimental than the advantages of operating in the black-only mode. Therefore, switching modes to black-only should only occur at certain occasions.

One occasion to switch includes when the image forming device 100 is idle and only one black-only page is in the print queue. Another occasion for switching includes when the next three pages in the print queue are black-only pages. Switching may also occur when the print queue is less than three pages and at least two consecutive pages are black-only pages. These are a few occasions of when switching modes is beneficial. Other occasions may also be used depending upon the context of use. If switching should not occur, then the image forming device 100 is set to the multi-color mode (step 201).

If a switch should occur, then only the black imaging station K is run-in and placed in the operational mode (step 202). The CMY non-operational imaging stations 150 are placed in the non-operational mode, and the corresponding transfer roller 165 for each is set to zero volts. Further, a rotate count is set to zero (step 203), and a count of printed black pages (K pages) is set to zero (step 204).

The next step is to print the black-only page which is the start of Loop 1 (step 205), and increment the count of printed black pages (K pages)(step 206). Controller 190 than determines whether the print queue is empty (step 207). If the queue is empty, it is then determined if the non-operational imaging stations 150 have a rotate count of zero (step 208). The rotate count indicates whether the PC members 153 of these imaging units 150 have been rotated to prevent a wear mark caused by contact with the moving ITM 129. If the rotate count is zero, the non-operational imaging stations 150 are rotated (step 209). The rotation moves new sections of the PC members 153 into contact with the ITM 129. Rotation may also move sections of the PC members 153 that may be exposed by the printhead 191. In one embodiment, the PC members 153 are moved about 5 mm. The black K imaging station 150 is run out and the black-only mode is completed (step 211).

If the print queue is not empty (step 207), it is then determined whether the next page is black-only (step 213). If the next page is multi-color, the controller 190 transitions each of the imaging stations 150 to the multi-color mode (step 214). If the next page is black-only, it is then determined whether the number of printed black pages Kpages is greater than an initial predetermined maximum (step 215). The initial predetermined maximum is set as the maximum amount of pages that can be printed before causing a wear mark on the non-operational PC members 153. If the initial predetermined maximum number is not exceeded, than the process stays in Loop 1 and loops back and prints the black-only page. If the maximum number of black-only pages is exceeded, the process moves to Loop 2 as described in the steps illustrated in FIG. 3.

The initial predetermined maximum number of black pages is predetermined to prevent leaving a wear mark on the stationary non-operating PC members 153 due to rubbing against the moving ITM 129. This maximum may also prevent damage to other elements within the non-operational imaging stations 150 such as the developer rollers 156 and the charger roller 152. To prevent wear marks, the non-operating imaging stations 150 are rotated to move a new section of the PC members 153 against the ITM 129. Rotation also moves the other elements in the imaging stations 150. Prior to rotating the PC members 153, it is determined whether the rotate count exceeds a maximum amount of rotation (step 301). The maximum amount of rotation is determined as a function of a length of the rotations and a distance between a contact point of the developer roller 156 and the PC member 153 and the first transfer point between PC member 153 and the ITM 129.

Figure 4:
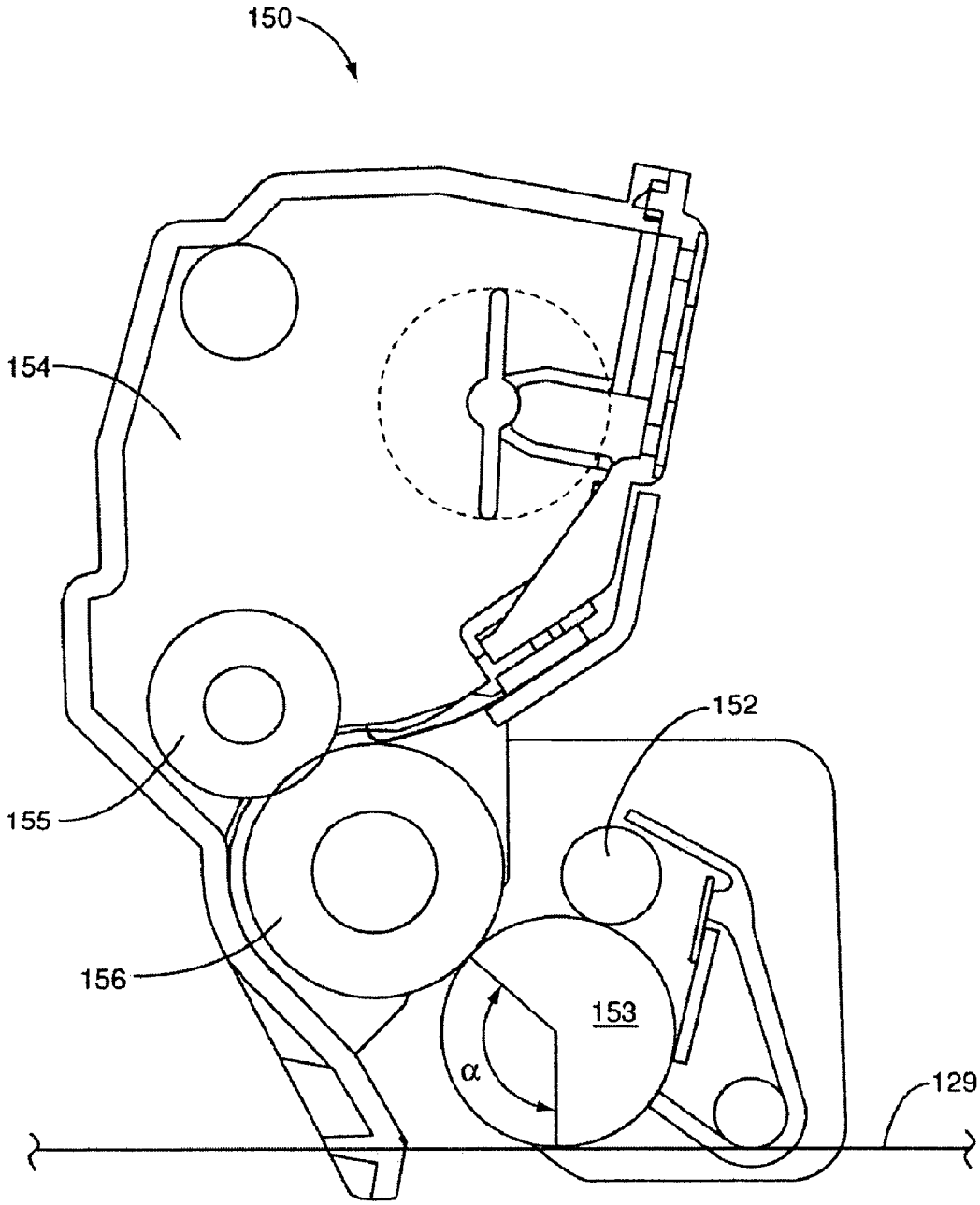
FIG. 4 is a schematic section view of an imaging station positioned at an intermediate transfer member according to one embodiment.

FIG. 4 illustrates a section view of an imaging station 150 with the developer roller 156 contacting against the PC member 153, and the first transfer point between the PC member 153 and the ITM 129. An angle $\alpha$ is formed between the contact point and the first transfer point. The length of the surface of the PC member 153 measured within the angle $\alpha$ is referred to as a toner free area and is the amount of available space for rotation. The maximum amount of rotation is determined by the angle $\alpha$ divided by the length of each rotation measured in degrees. The amount of rotation is determined by how accurate the controller 190 can control the degrees of rotation. In one embodiment, angle $\alpha$ is about 133 degrees, and the controlled rotation is about 22 degrees. Therefore, the maximum number of rotations is 6 (i.e., 133/6). In some embodiments, the amount of rotation could be different based on the diameter of the PC member 153, the relative locations of the developer roller 156 and the first transfer area 140, and the ability of the controller 190 to control the motor rotation.

Figure 3:
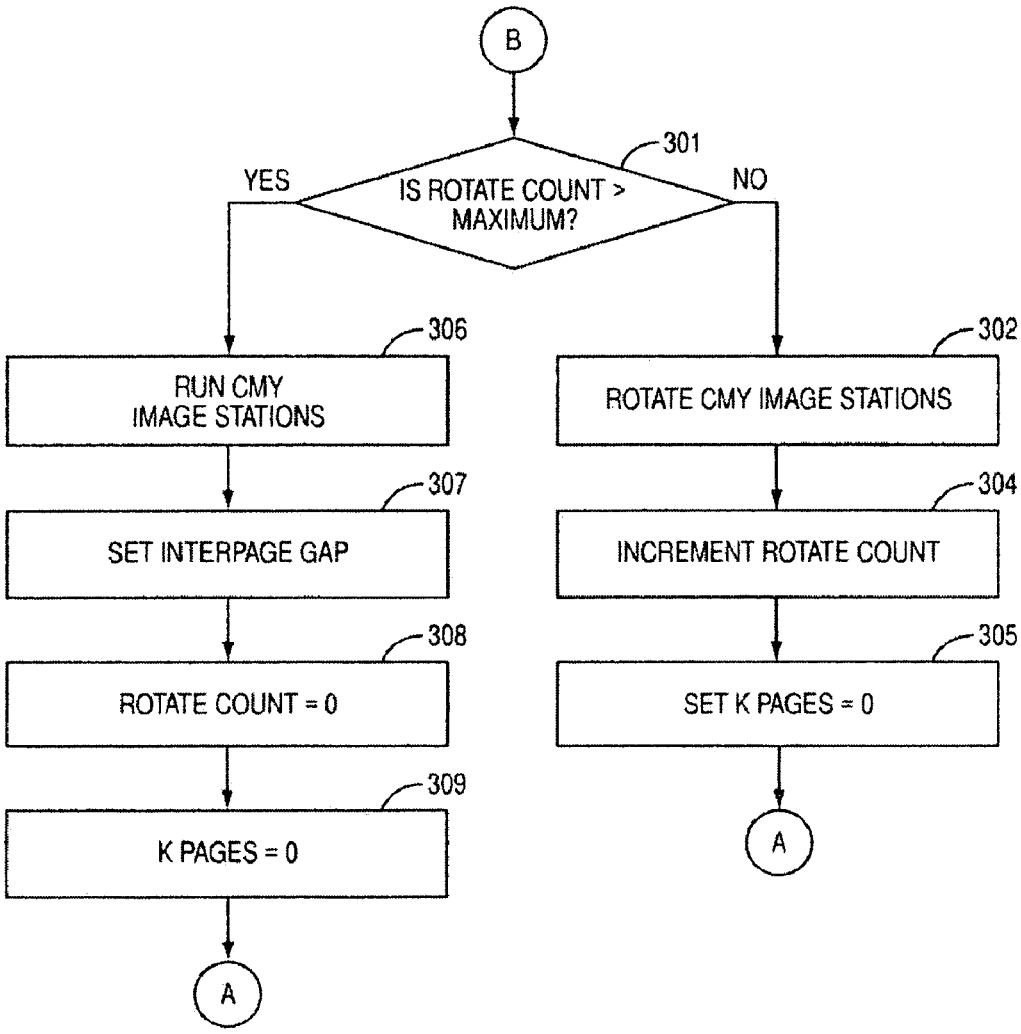
FIG. 3 is a process diagram of a partial method of forming a toner image according to one embodiment.

Returning to the flowchart of FIG. 3, if the number of rotations does not exceed the maximum, than the non-operational imaging stations 150 are rotated (step 302). Further, the rotate count is incremented by one (step 304), and the number of black-only pages Kpages is set equal to zero (step 305). Printing of the black-only page may occur simultaneously with, before, or after steps 302, 304, and 305 with the rotation occurring during the interpage gap.

The maximum number of black-only jobs that can be printed before conditioning the non-operating PC members 153 and other elements is a function of number of black-only pages that can be printed for each rotate location and the maximum rotate count. If the maximum number of black-only pages is 20 for each location on the PC members 153 and the maximum rotate count is 5, than 100 black-only pages may be printed before conditioning the non-operational PC members 153. In another example, a maximum black-only pages of 40 and a maximum rotate count of 6 allows for 240 black-only pages to be printed before conditioning the non-operational PC members 153 and the other elements.

If the rotate count does exceed the maximum (step 301), then it is necessary in Loop 3 to reset the non-operational imaging stations 150. This occurs when the toner free area formed on the surface of the non-operational PC members 153 has been used. As a result, the controller 190 will re-establish an initial condition on the non-operational PC members 153 to create new toner free areas. Further, the controller 190 will move other elements within the imaging stations 150 to prevent damage to these elements. Returning to FIG. 3, the non-operational imaging stations 150 are activated for a predetermined amount of time or movement of the imaging stations 150 (step 306). In one embodiment, the activation causes the PC members 153 to rotate about two revolutions. Further, an interpage gap between media sheets is set to a predetermined amount (step 307). In one embodiment, the interpage gap is about 205 mm. The black-only sheet is printed either at the same time, before, or after the non-operating imaging stations 150 are activated. After the non-operational imaging stations 150 are reset, then both the rotate count (step 308) and the black-only pages Kpages (step 309) are set equal to zero.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of operating a multi-color image forming device in a mono-color mode comprising:

determining whether an initial maximum number of mono-color pages have been printed;

when the initial maximum number of mono-color pages has not been printed, printing the mono-color page with a first imaging station that is last in a process direction while a remainder of imaging stations are in a non-operational mode and;

when the initial maximum number of mono-color pages has been printed, activating the non-operational imaging stations a limited first amount and printing the mono-color page with the first imaging station;

determining an overall number of mono-color pages printed based on a number of incremental rotations available for each non-operational imaging station and the initial maximum number of mono-color pages for each of the incremental rotations; and when the overall number of mono-color pages have been printed, resetting the non-operational imaging stations by activating the non-operational imaging stations a greater amount than the first amount and printing the mono-color page with the first imaging station.

2. The method of claim 1, further comprising classifying incoming pages as one of the mono-color pages and multi-color pages.

3. The method of claim 1, wherein activating the non-operational imaging stations the limited first amount includes rotating a photoconductive (PC) member in each of the non-operational imaging stations and preventing a wear spot from forming on each of the PC members due to contact with an intermediate transfer member.

4. The method of claim 1, further comprising when the initial maximum number of mono-color pages has been printed, activating the non-operational imaging stations the limited first amount during an interpage gap.

5. The method of claim 1, further comprising when the overall number of mono-color pages have been printed, resetting the non-operational imaging stations by activating the non-operational imaging stations the greater amount than the first amount at a same time as printing the mono-color page with the first imaging station.

6. The method of claim 1, further comprising classifying an incoming page as a multi-color page and transitioning the non-operational imaging stations to a multi-color mode.

7. A method of operating a multi-color image forming device in a mono-color mode comprising:

determining whether an initial maximum number of mono-color pages have been printed;

when the initial maximum number of mono-color pages has not been printed, printing the mono-color page with a first imaging station that is last in a process direction while a remainder of imaging stations are in a non-operational mode and;

when the initial maximum number of mono-color pages has been printed, activating the non-operational imaging stations a limited first amount and printing the mono-color page with the first imaging station; and when an overall number of mono-color pages have been printed, resetting the non-operational imaging stations by activating the non-operational imaging stations a greater amount than the first amount and printing the mono-color page with the first imaging station, wherein activating the non-operational imaging stations a greater amount than the first amount includes rotating photoconductive (PC) members in each of the non-operational imaging stations at least two rotations.

8. A method of operating a multi-color image forming device in a mono-color mode comprising:

when a mono-color page counter is less than a predetermined maximum, printing a page in the mono-color mode by transferring toner from a first photoconductive (PC) member to an intermediate transfer member while second and third PC members remain stationary and in contact with the intermediate transfer member;

when the mono-color page counter exceeds the predetermined maximum, determining whether toner free areas are available on the second and third PC members;

when toner free areas are available, rotating the second and third PC members a limited distance and moving new sections of the toner free areas into contact with the intermediate transfer member; and when toner free areas are not available, rotating the second and third PC members and resetting the toner free areas.

9. The method of claim 8, wherein resetting the toner free areas comprises rotating the second and third PC members an amount greater than the limited distance.

10. The method of claim 8, further comprising setting voltages to zero on transfer rollers for the second and third PC members.

11. The method of claim 8, further comprising rotating the second and third PC members the limited distance and moving new sections of the toner free areas into contact with the intermediate transfer member during an interpage gap.

12. The method of claim 8, further comprising printing the mono-color page with the first PC member while rotating the second and third PC members and resetting the toner free areas.

13. The method of claim 8, further comprising classifying an incoming page as a multi-color page and transitioning the second and third PC members to a multi-color mode.

14. The method of claim 8, further comprising printing the page with black toner.

15. A method of operating a multi-color image forming device in a mono-color mode comprising:

determining a first page may be printed with a mono-color mode;

placing a first imaging station in an operational mode and rotating a first photoconductive (PC) member of the first imaging station against an intermediate transfer member;

placing second and third imaging stations in a non-operational mode with each of a second PC member of the second imaging station and a third PC member of the third imaging station being stationary and in contact with the intermediate transfer member;

printing the first page in the mono-color mode with the first imaging station while the second and third imaging stations are in the non-operational mode;

incrementing a mono-color page counter;

determining a second page may be printed with the mono-color mode;

when the mono-color page counter is less than a predetermined maximum, printing the second page in the mono-color mode;

when the mono-color page counter is greater than the predetermined maximum, determining whether toner free areas are available on the second and third PC members;

when toner free areas are available, rotating the second and third PC members a limited distance and moving new sections of the toner free areas into contact with the intermediate transfer member; and when toner free areas are not available, rotating the second and third PC members and resetting the toner free areas.

16. The method of claim 15, further comprising rotating the second and third PC members the limited distance and moving new sections of the toner free areas into contact with the intermediate transfer member during an interpage gap.

17. The method of claim 15, further comprising printing the second page at a same time as rotating the second and third PC members and resetting the toner free areas.

18. The method of claim 15, further comprising rotating the second and third PC members when a print queue is empty after printing the first page.

19. The method of claim 15, further comprising printing the first and second pages with black toner.

* * * * *